US005904094A

United States Patent [19]

Bredenberg

[11] Patent Number: 5,904,094

[45] Date of Patent: May 18, 1999

[54] ROLLER ARRANGEMENT IN A FOLDING APPARATUS OF A WEB-FED ROTARY PRINTING PRESS

[75] Inventor: Paul Emmett Bredenberg, Kittery, Me.

[73] Assignee: Heidelberger Druckmaschinen AG, Heidelberg, Germany

[21] Appl. No.: 08/926,058

[22] Filed: Sep. 9, 1997

[51] Int. Cl.[6] ..... B41F 5/00

[52] U.S. Cl. ..... 101/216; 101/227; 226/108

[58] Field of Search ..... 101/181, 219, 101/225, 228; 226/4, 10, 24, 108, 109, 110, 112, 113, 114, 181, 185, 186, 187, 188, 189, 195

[56] References Cited

U.S. PATENT DOCUMENTS

| | | | |
|---|---|---|---|
| 2,320,659 | 6/1943 | Sahlin | 226/195 |
| 3,280,737 | 10/1966 | Huck | 101/219 |
| 3,325,071 | 6/1967 | Schmitz | 226/108 |
| 3,386,679 | 6/1968 | Foulon et al. | 226/109 |
| 4,078,416 | 3/1978 | Voorhees et al. | 226/181 |
| 4,896,605 | 1/1990 | Schröder | 101/227 |
| 5,019,203 | 5/1991 | Singer | 226/187 |
| 5,052,296 | 10/1991 | Shiba | 226/109 |
| 5,072,872 | 12/1991 | Casset et al. | 226/186 |
| 5,398,604 | 3/1995 | Burke et al. . | |
| 5,458,062 | 10/1995 | Goldberg et al. | 101/227 |
| 5,511,712 | 4/1996 | Holm et al. | 101/228 |
| 5,727,724 | 3/1998 | Dowling | 226/185 |

FOREIGN PATENT DOCUMENTS

| | | | |
|---|---|---|---|
| 0 747 312 A2 | 12/1996 | Germany . | |
| 804659 | 11/1958 | United Kingdom | 226/186 |

*Primary Examiner*—Eugene Eickholt
*Attorney, Agent, or Firm*—Kenyon & Kenyon

[57] ABSTRACT

A roller arrangement in a folding apparatus of a rotary printing press includes a plurality of gathering rollers for passing a plurality of incoming ribbons along a line substantially tangential to the plurality of gathering rollers, thereby forming a multi-layered web. A first nip roller and a second nip roller, each having a coating of a resilient material are arranged such that the layered web is passed through a nip formed between the first and second nip rollers substantially tangential to each of the first and second nip rollers.

7 Claims, 2 Drawing Sheets

ROLLER ARRANGEMENT IN A FOLDING APPARATUS OF A WEB-FED ROTARY PRINTING PRESS

FIELD OF THE INVENTION

The present invention relates to a roller arrangement in a folding apparatus of a web-fed rotary printing press. In particular, the present invention relates to a roller arrangement for feeding a plurality of printed webs or ribbons as a multi-layered web to a pair of nip rollers located on top of a former board in a folding apparatus of a web-fed rotary printing press.

BACKGROUND INFORMATION

In a folding apparatus which is coupled to one or more rotary printing presses, a plurality of printed webs or ribbons is usually passed over a corresponding number of gathering rollers in order to arrange the ribbons on top of each other before feeding them as a multi-layered web to a pair of nip rollers, arranged on top of a former board for longitudinally folding the layered web.

In prior art folding apparatuses, the nip rollers consist of a driven metal roller, usually a steel roller, and a non-driven rubber or urethane roller which is pressed against the driven metal roller with an adjustable force, in order to adjust the friction between the layered web and the driven metal roller so as to thereby control the tension of the layered web before it passes the former board. Owing to their compact and space efficient design, the gathering rollers and the nip rollers located on top of the former board are arranged such that the layered web is fed at an angle to the nip of the nip rollers. Therefore, the layered web either wraps around both nip rollers or wraps around the circumference of one of the nip rollers, while it only peripherally contacts the other nip roller. Due to the so-called radius effect, the ribbons of the layered web which are passed over the outside of the wrapped nip roller are pulled off more rapidly than the ones which pass over the inside of the roller because of their greater distance from the center of the roller. If the ribbons are afterwards passed to the inside of a subsequent roller, e.g., the nip rollers behind the former board, wrinkles and other undesirable irregularities of the printed and folded products can occur severely affecting the quality of the printed products.

European Patent Application No. 0 747 312 A1 purports to disclose a folding apparatus comprising an arrangement of gathering or take-off rollers for feeding at least two webs as a multi-layered web to an intake roller arranged above a former board for folding the layered web. In this apparatus, the layered web is fed at an angle to the intake roller and the intake roller is formed by a single guide roller which is not in contact with another roller and which therefore does not allow a control of the web tension.

U.S. Pat. No. 5,398,604 discloses a nip roller arrangement comprising a driven transport roller rotatably supported in bearings fixed to a frame and an associated nip roller carrying a removable nip sleeve which is made of resilient material. The nip roller is rotatably supported in pivotable arms and can be brought into contact with the conventionally constructed driven transport roller by means of a pneumatic actuator.

It is an object of the present invention to provide for a roller arrangement in a folding apparatus of a web-fed rotary printing press which eliminates the occurrence of an unequal tension among the respective single ribbons of a layered web when feeding the layered web through a nip formed between a pair of nip rollers.

It is another object of the present invention to eliminate the occurrence of wrinkles and other undesirable irregularities in the printed product which are caused by the radius effect when transporting a layered web through a nip of a pair of nip rollers located on top of a former board for longitudinally folding the layered web.

SUMMARY OF THE INVENTION

According to a first exemplary embodiment of the present invention, a roller arrangement in a folding apparatus of a rotary printing press comprises a plurality of gathering rollers for passing a plurality of incoming ribbons along a line substantially tangential to the plurality of gathering rollers, thereby forming a multi-layered web, and further comprises a first and a second nip roller, each having a coating of resilient material and being arranged such the multi-layered web is passed through a nip formed between the nip rollers substantially tangential to each of the nip rollers.

It is an advantage of the roller arrangement according to the present invention that it provides for a precise and safe transportation of the layered web to and over a downstream former board, which leads to an increased accuracy of the longitudinal fold applied to the layered web when passing over the former board.

DETAILED DESCRIPTION OF THE INVENTION

Figure 1:
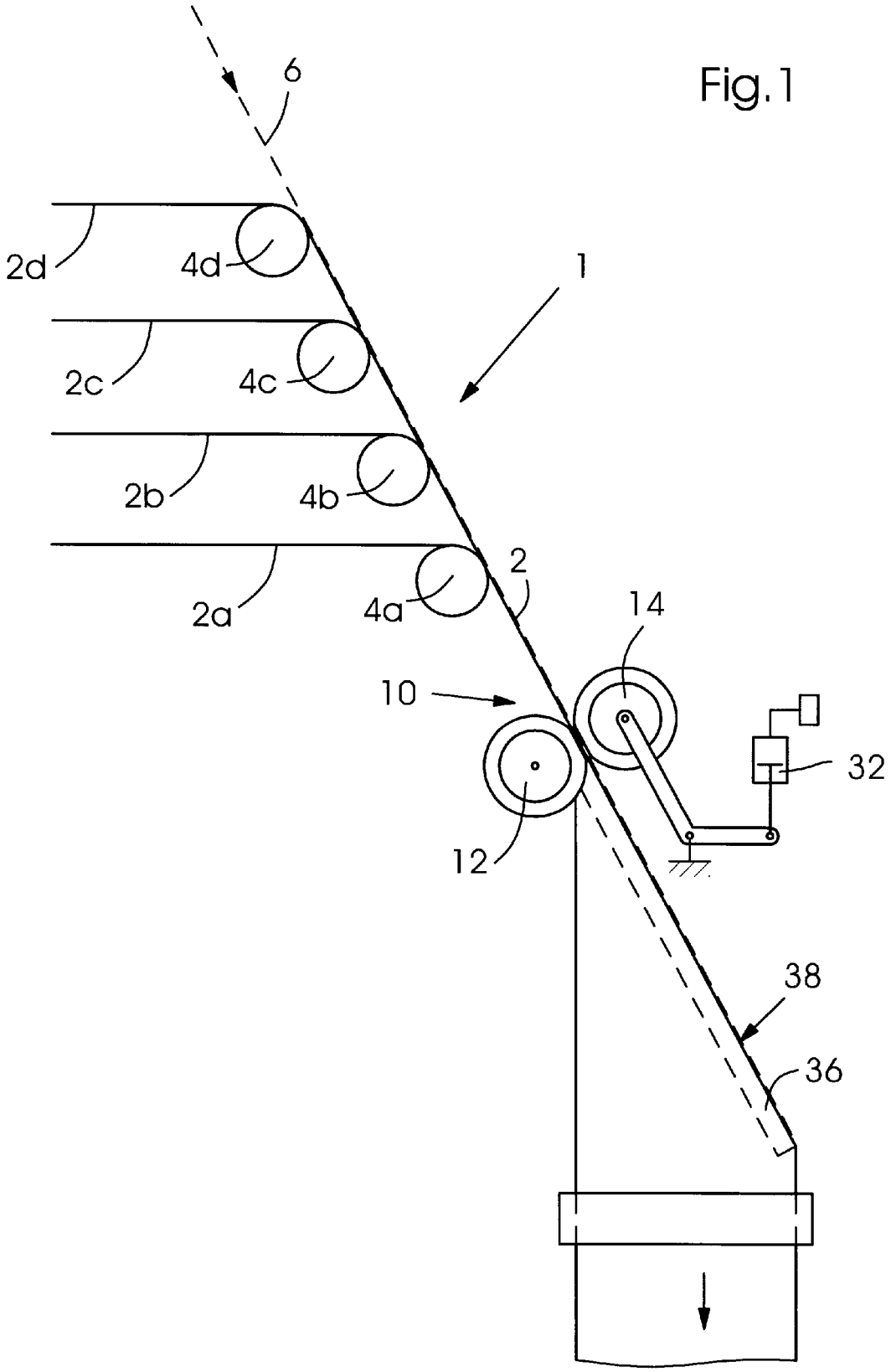
FIG. 1 is a schematic side view of an exemplary roller arrangement of the present invention with a former board and nip rollers located downstream of the former board.

As shown in FIG. 1, a roller arrangement 1 for feeding a layered or multi-layered web 2 including two, three, or more superposed printed single ribbons 2*a*, 2*b*, 2*c*, 2*d* to a former board 36 in a folding apparatus (not shown) includes, for example, a variety of gathering or take-off rollers 4*a*, 4*b*, 4*c*, 4*d* over which the respective incoming ribbons 2*a*, 2*b*, 2*c*, 2*d* are passed. The ribbons 2*a*, 2*b*, 2*c*, 2*d* are, for example, printed with different images in associated printing units (not shown) which are located upstream of the folding apparatus, as viewed in the running direction of the ribbons 2*a*, 2*b*, 2*c*, 2*d*.

The gathering rollers 4*a*, 4*b*, 4*c*, 4*d* are preferably non-driven idle rollers as are known and used in prior art folding apparatuses. Alternatively, the gathering rollers 4*a*, 4*b*, 4*c*, 4*d* can also be rollers which are driven by one or more electric motors (not shown). The gathering rollers 4*a*, 4*b*, 4*c*, 4*d* are preferably formed of a rigid material, e.g., steel or aluminum, but can also be coated with a layer of resilient material as e.g., rubber or urethane.

As further shown in FIG. 1, the gathering rollers 4*a*, 4*b*, 4*c*, 4*d* are arranged such that each of the ribbons 2*a*, 2*b*, 2*c*, 2*d* is directed along a line 6, indicated by dashed lines in FIG. 1, which is substantially tangential to the gathering rollers 4*a*, 4*b*, 4*c*, 4*d*. In other words, the alignment of the gathering rollers 4*a*, 4*b*, 4*c*, 4*d* is such that the peripheral lines 8*a*, 8*b*, 8*c*, 8*d*, at which a respective ribbon 2*a*, 2*b*, 2*c*, 2*d* loses contact with its associated gathering roller 4*a*, 4*b*, 4*c*, 4*d*, are located along the line 6, which is substantially tangential to each of the gathering rollers 4*a*, 4*b*, 4*c*, 4*d*, so that the layered web 2 is running substantially along the tangent line 6.

The multi-layered web 2, which is formed, for example, by the superposed ribbons 2*a*, 2*b*, 2*c*, 2*d* as described above, is afterwards fed to a nip 10 provided between a first nip roller 12 and an associated second nip roller 14.

As shown in FIG. 1, the first and the second nip rollers 12, 14 are arranged in such a way that the tangent line 6 is located substantially in the center of the nip 10 and a line 16 running through the centers of first and second nip rollers 12, 14 is substantially perpendicular to the tangent line 6. In other words, the nip rollers 12, 14 are arranged such that the layered web 2 is tangential to each of the first and second nip rollers 12, 14, without wrapping around the circumference of one of the nip rollers 12, 14 when the web 2 is transported through the center of the nip 12.

Figure 2:
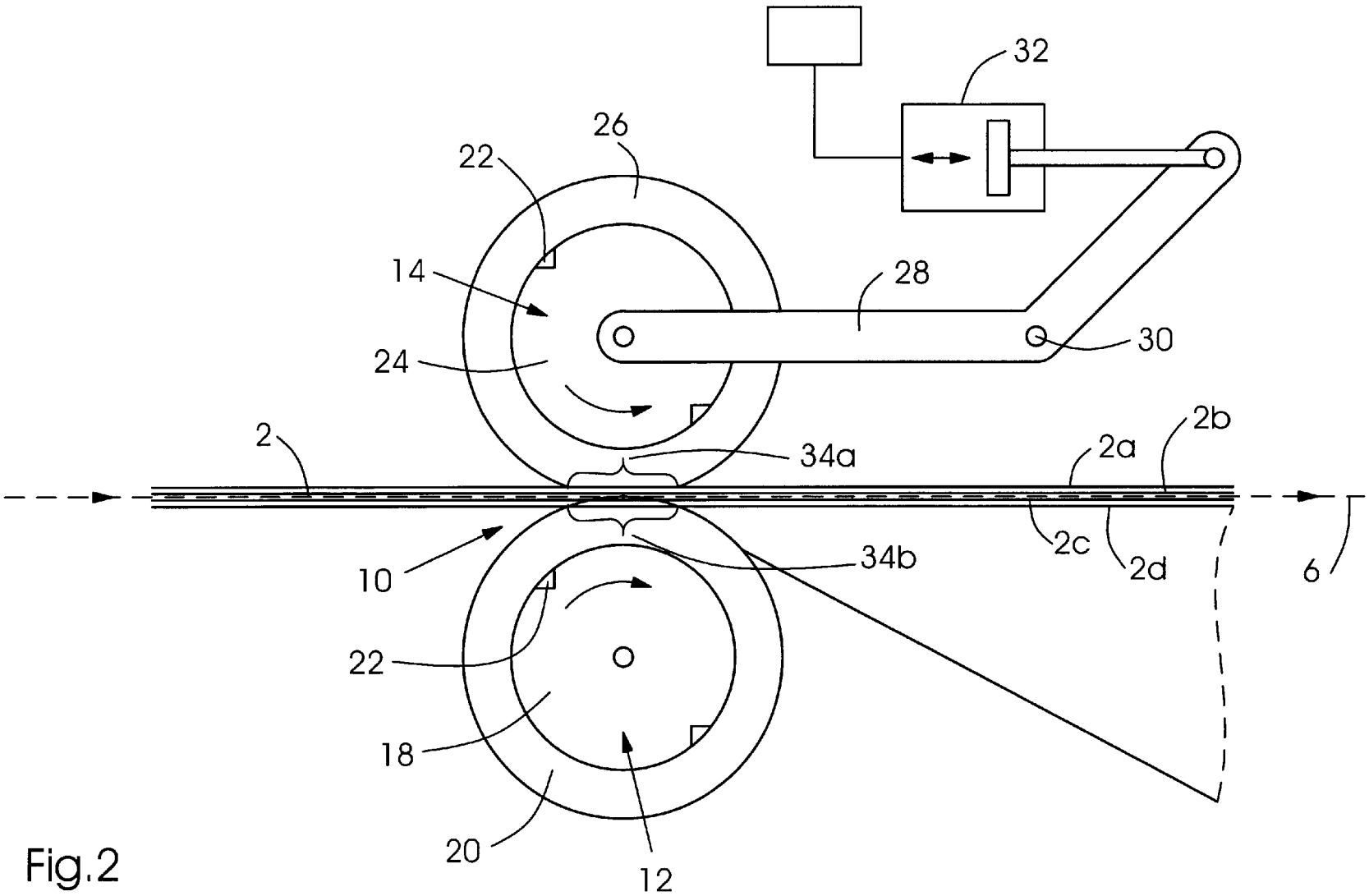
FIG. 2 is a more detailed cross sectional view of the nip rollers used in the roller arrangement according to an exemplary embodiment of the present invention.

In an exemplary embodiment of the present invention illustrated in FIG. 2, the first nip roller 12 is a driven roller having a core or body 18 which is coated with a layer 20 of resilient material, as e.g., rubber or urethane. The coating or layer 20 is preferably formed by an endless sleeve which can be fixed to the core 18 by glue or by means of a schematically indicated groove-key-joint 22.

The second nip roller 14 is preferably of the same design as the first nip roller 12, having a core or body 24 of rigid material, preferably steel or aluminum, and a layer or coating 26 of resilient material affixed to the body 24 by glue or by means of a groove-key-joint 22. In the same way as already described for the first nip roller 12, the coating 26 of the second nip roller 14 is also preferably a continuous rubber or polyurethane sleeve. Although the design of the two nip rollers 12, 14 is preferably identical, it is also possible that they are formed of compliant material, such that the deformation of the coating 20 of the first roller 12 mirrors the deformation of the coating 26 of the second roller 14.

In an exemplary embodiment of the present invention, the second nip roller 14 is a non-driven roller which is rotatably supported in pivotable arms 28. The pivotable arms 28 can be pivoted about an axis 30 by means of a known actuator, e.g., a pneumatic cylinder 32, in order to bring the second nip roller 14 into and out of contact with the first nip roller 12. By varying the pressure in the pneumatic cylinder 32 of the actuator, the contacting force between the two nip rollers 12, 14 can be adjusted in order to control the drag or the tension of the layered web 2.

Owing to the design of the first and second nip rollers 12, 14 and the straight and symmetrical transportation of the layered web 2 through the nip 10, all of the superposed ribbons 2*a*, 2*b*, 2*c*, 2*d* forming the layered web 2 are transported through the nip 10 with substantially the same velocity. Furthermore, the symmetrical deformation of the resilient coatings 20 and 26 of the first and second nip rollers 12, 14 provides for a substantially constant surface velocity of each coating 20, 26 in the entire contacting zone 34*a*, 34*b*, in which the coatings 20, 26 are in contact with the layered web 2.

After the layered web 2 has passed the nip 10, it is fed to a known former board 36 and a further pair of nip rollers 40 located below the former board 36 for longitudinally folding the layered web 2. As can be seen from FIG. 1, the first and second nip rollers 12, 14 are preferably arranged on top of the former board 36, whereby the arrangement of the first and second nip rollers 12, 14 above the former board 36 is preferably such that the layered web 2 leaves the nip 10 tangentially to both nip rollers 12, 14 and to the top plane 38 of the former board 36. Although the arrangement of the gathering rollers 4*a*, 4*b*, 4*c*, 4*d*, the first and second nip rollers 12, 14 and the top plane 38 of the former board 36 is preferably such that the layered web 2 travels along the tangent line 6, some angular deviations from tangency may be acceptable, depending on the specific application and design of the folding apparatus. For example, the angle at which the layered web 2 enters the nip 10 between the first and second nip roller 12, 14 can deviate from the direction of the tangent line 6 by e.g., ±3°. In the same way, the angle between the layered web 2 leaving of the nip 10 and the tangent line 6 and/or between the tangent line 6 and the top plane 38 of the former board 36 can also be in the range of about ±3°.

Moreover, it is also possible to use the roller arrangement 1 according to the present invention in other sections of a folding apparatus.

What is claimed is:

1. A roller arrangement in a folding apparatus of a rotary printing press, comprising:

a plurality of gathering rollers for passing a plurality of incoming ribbons along a line substantially tangential to the plurality of gathering rollers, thereby forming a layered web superposed of the plurality of incoming ribbons; and a first nip roller and a second nip roller, each having a coating of resilient material and being arranged such that the layered web passes through a nip formed between the first nip roller and the second nip roller substantially tangentially to each of the first and second nip rollers.

2. The roller arrangement according to claim 1, further comprising a former board disposed adjacent to the first and second nip rollers, the former board having a top plane and being arranged such that the top plane extends substantially along the tangent line.

3. The roller arrangement according to claim 1, wherein the first and second nip rollers comprise a core of rigid material and an endless coating of resilient material affixed to the core.

4. The roller arrangement according to claim 3, wherein the first and second nip rollers each have a substantially identical design.

5. The roller arrangement according to claim 1, wherein at least one of the first and second nip rollers is rotatably supported in a pair of pivotable arms, the pivotable arms being coupled to an actuator for pivoting the arms such that the first nip roller is brought into contact with the second nip roller.

6. The roller arrangement according to claim 5, wherein the contacting force between the first nip roller and the second nip roller is adjustable by the actuator.

7. The roller arrangement according to claim 5, wherein the actuator is a pneumatic cylinder.

* * * * *